US009958179B2

(12) United States Patent
Sugiyama et al.

(10) Patent No.: US 9,958,179 B2
(45) Date of Patent: May 1, 2018

(54) AIR-CONDITIONING SYSTEM

(71) Applicant: Mitsubishi Electric Corporation, Tokyo (JP)

(72) Inventors: Daisuke Sugiyama, Tokyo (JP); Hideki Takahara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 494 days.

(21) Appl. No.: 14/457,318

(22) Filed: Aug. 12, 2014

(65) Prior Publication Data

US 2015/0068234 A1 Mar. 12, 2015

(30) Foreign Application Priority Data

Sep. 9, 2013 (JP) ..... 2013-186177

(51) Int. Cl.
*F25B 49/00* (2006.01)
*F24F 11/00* (2018.01)
*F24F 1/00* (2011.01)

(52) U.S. Cl.
CPC ..... *F24F 11/006* (2013.01); *F24F 1/0003* (2013.01); *F24F 2011/0057* (2013.01); *F24F 2011/0064* (2013.01); *F24F 2011/0068* (2013.01); *F24F 2011/0071* (2013.01); *F25B 2600/07* (2013.01)

(58) Field of Classification Search
CPC ..... F24F 2011/0057; F24F 2011/0064; F24F 2011/0067–2011/0072; F25B 2600/07
USPC ..... 62/125–127
See application file for complete search history.

(56) References Cited

U.S. PATENT DOCUMENTS 5,381,954 A * 1/1995 Tokizaki ..... F24F 11/0009 165/259
6,619,055 B1 * 9/2003 Addy ..... F24F 11/006 236/46 R
2001/0022089 A1 * 9/2001 Wada ..... F24F 11/006 62/126
2004/0107717 A1 * 6/2004 Yoon ..... F24F 11/006 62/230

(Continued)

FOREIGN PATENT DOCUMENTS

EP 1429082 A2 6/2004
EP 2351971 A2 8/2011

(Continued)

OTHER PUBLICATIONS

Tani (JP 2007-024420), machine translation.*

(Continued)

*Primary Examiner* — Hung Q Nguyen
*Assistant Examiner* — Mark L Greene
(74) *Attorney, Agent, or Firm* — Posz Law Group, PLC

(57) ABSTRACT

A control unit includes a mode control unit that, when a test operation switch is turned on, transmits information indicating that a test operation mode is performed to a centralized management device via an adapter and an external network. When the information indicating that the test operation mode is performed is received, the centralized management device restricts an operation on the operation terminal to prevent an operation of the air-conditioning apparatus from being changed via the operation terminal.

16 Claims, 8 Drawing Sheets

(56) References Cited

U.S. PATENT DOCUMENTS

| | | | | |
|---|---|---|---|---|
| 2006/0112700 | A1* | 6/2006 | Choi | F24F 11/0086 62/126 |
| 2009/0025406 | A1* | 1/2009 | Yoshimi | F24F 11/008 62/127 |
| 2010/0250724 | A1* | 9/2010 | Kawai | F24F 11/006 709/223 |
| 2010/0292960 | A1* | 11/2010 | Sung | F24F 11/0086 702/184 |
| 2014/0012543 | A1* | 1/2014 | Son | G01M 99/005 702/185 |
| 2015/0179056 | A1* | 6/2015 | Nakatani | G08C 17/02 340/12.5 |

FOREIGN PATENT DOCUMENTS

| | | | |
|---|---|---|---|
| JP | 2005-184711 | A | 7/2005 |
| JP | 2007-024420 | A | 2/2007 |
| JP | 2010-034957 | A | 2/2010 |
| JP | 2013-024434 | A | 2/2013 |
| WO | 2013/128527 | A1 | 9/2013 |

OTHER PUBLICATIONS

Tani, JP 2005-184711, Jul. 7, 2005, machine translation.*
Extended European Search Report dated Sep. 30, 2015 in the corresponding EP Application No. 14182544.8.
Office Action dated Dec. 8, 2015 in the corresponding JP application No. 2013-186177 (with English translation).
Japanese Office Action dated Jun. 28, 2016 in the corresponding JP application No. 2013-186177. ( English translation attached).
Office Action dated Aug. 2, 2016 issued in corresponding CN patent application No. 201410454352.4 (and English translation).
Australian Office Action dated Jun. 19, 2015 in the corresponding Australian application No. 2014215943.
Office Action dated Mar. 1, 2017 issued in corresponding CN patent application No. 201410454352.4 (and English translation).

* cited by examiner

AIR-CONDITIONING SYSTEM

TECHNICAL FIELD

The present invention relates to an air-conditioning system.

BACKGROUND ART

A technique has conventionally been proposed which is associated with an air-conditioning apparatus that a user away from his or her house can remotely operate with a terminal, such as a mobile phone (refer to, for example, Patent Literature 1).

With the technique disclosed in Patent Literature 1, operation instructions which the user away from his or her house can issue via the terminal, such as a mobile phone, are restricted in accordance with details of an operation instruction issued through remote control by another user in his or her house. This prevents transition to an operation that is not intended by the other user in the house, for example, transition to a heating operation when the user away from the house operates as such while a cooling operation is performed when the other user in the house operates as such.

CITATION LIST

Patent Literature

[Patent Literature 1] Japanese Unexamined Patent Application Publication No. 2007-24420 (refer to, for example, FIG. 3)

SUMMARY OF INVENTION

Technical Problem

Some air-conditioning apparatuses include a test operation switch that is used to determine whether the air-conditioning apparatus operates properly when a serviceperson checks or repairs the air-conditioning apparatus. When the serviceperson turns on the test operation switch, a program stored in a control unit in advance is started to operate, for example, an air-sending fan and air vanes of an indoor unit and a compressor of an outdoor unit in accordance with the program.

The technique disclosed in Patent Literature 1 has the following shortcomings: details of the operation of the air-conditioning apparatus may be changed remotely through a terminal, such as a mobile phone, during determination as to whether the air-conditioning apparatus operates properly after turn-on of the test operation switch. Specifically, according to the technique disclosed in Patent Literature 1, it is often hard for a serviceperson to check the air-conditioning apparatus. Disadvantageously, this leads to lowered ease of maintenance of the air-conditioning apparatus.

The present invention has been made to overcome the above-described disadvantage, and has as its object to provide an air-conditioning system that suppresses degradation in ease of maintenance.

Solution to Problem

The present invention provides an air-conditioning system including an air-conditioning apparatus that includes an indoor unit and an outdoor unit, an adapter connected to the indoor unit and configured to communicate with the indoor unit, and a centralized management device configured to communicate with an operation terminal to receive operation information for operating the air-conditioning apparatus from the operation terminal and further communicate with the adapter via an external network. The indoor unit includes a test operation switch used to perform a test operation mode in which a preset operation is executed, and a control unit connected to the adapter and configured to perform the test operation mode when the test operation switch is turned on. The control unit includes a mode control unit configured to, when the test operation switch is turned on, transmit information indicating that the test operation mode is performed to the centralized management device via the adapter and the external network. The centralized management device is configured to, when the information indicating that the test operation mode is performed is received, restrict an operation on the operation terminal to prevent an operation of the air-conditioning apparatus from being changed via the operation terminal.

Advantageous Effects of Invention

Since the air-conditioning system according to the present invention has the above-described configuration, it can suppress degradation in ease of maintenance.

DESCRIPTION OF EMBODIMENT

The embodiment(s) of the present invention will now be described with reference to the accompanying drawings.

Embodiment

Figure 1:
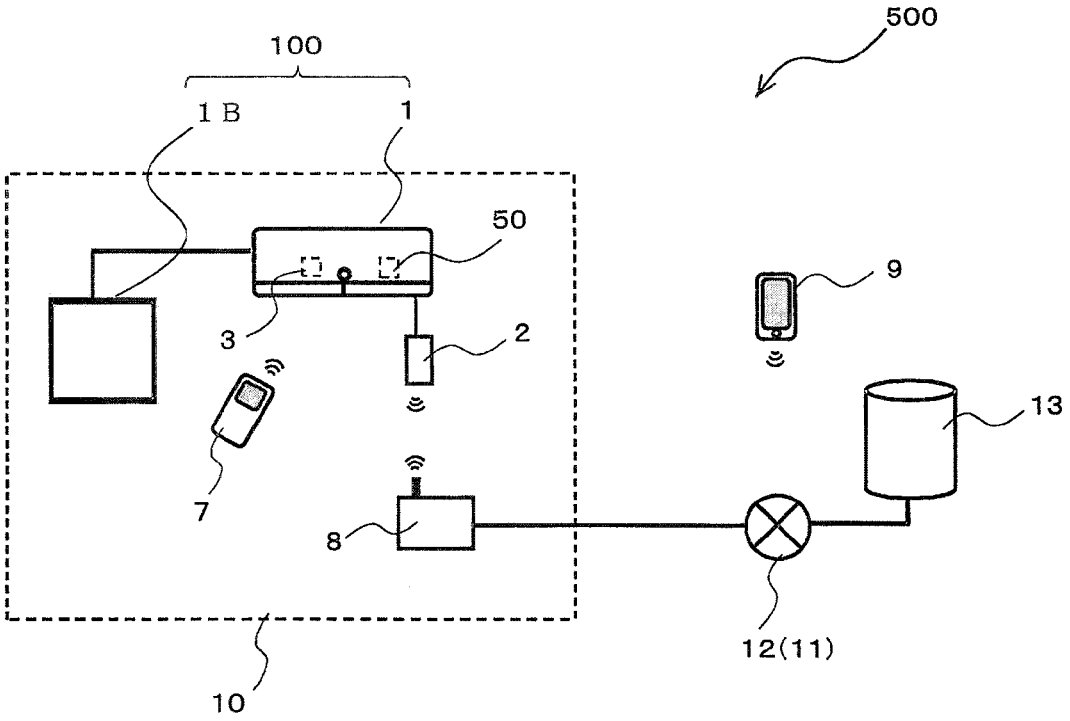
FIG. 1 is a schematic diagram showing an air-conditioning system including an air-conditioning apparatus according to an embodiment of the present invention.
Figure 2A:
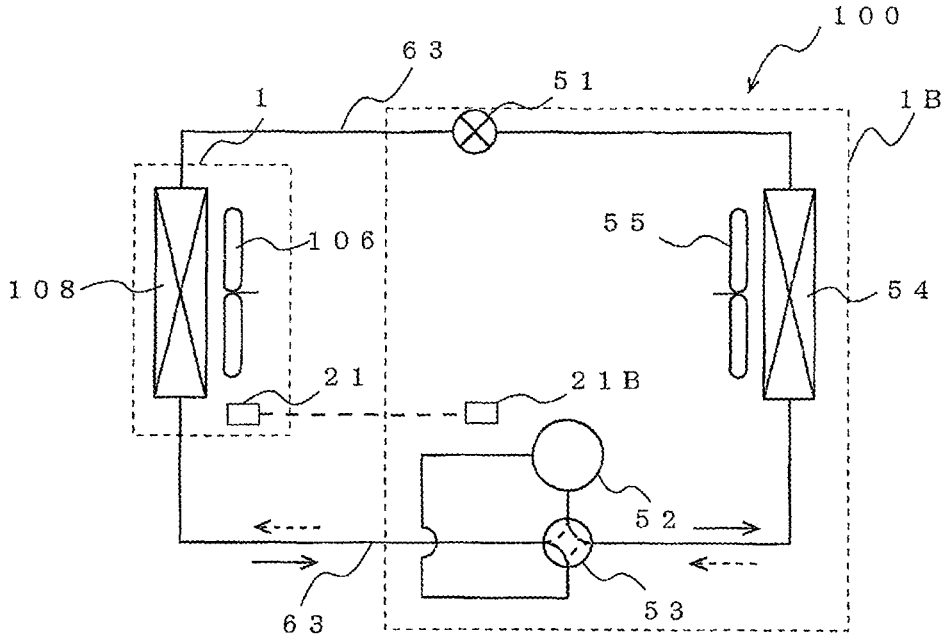
FIG. 2A is a circuit diagram for explaining a refrigerant circuit for the air-conditioning apparatus according to the embodiment of the present invention.
Figure 2B:
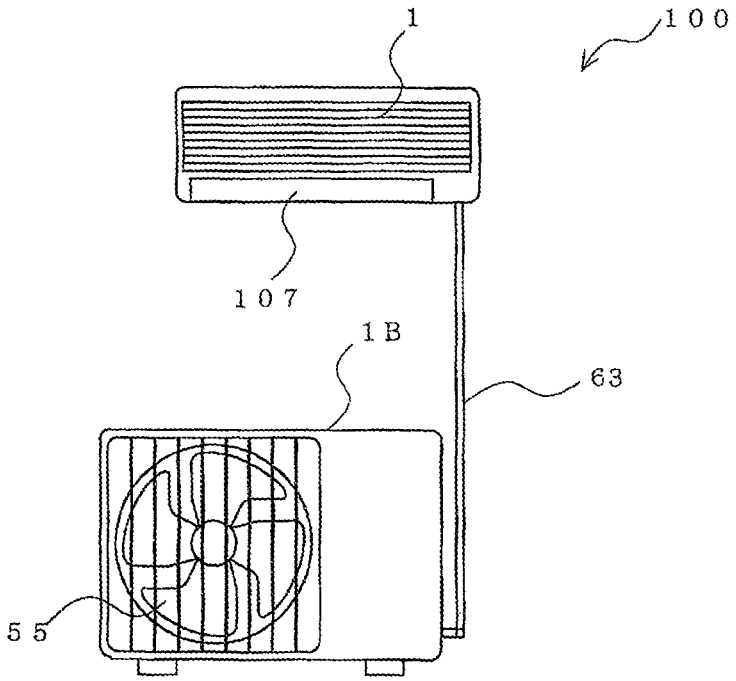
FIG. 2B is a schematic diagram illustrating the schematic configuration of the air-conditioning apparatus according to the embodiment of the present invention.
Figure 3:
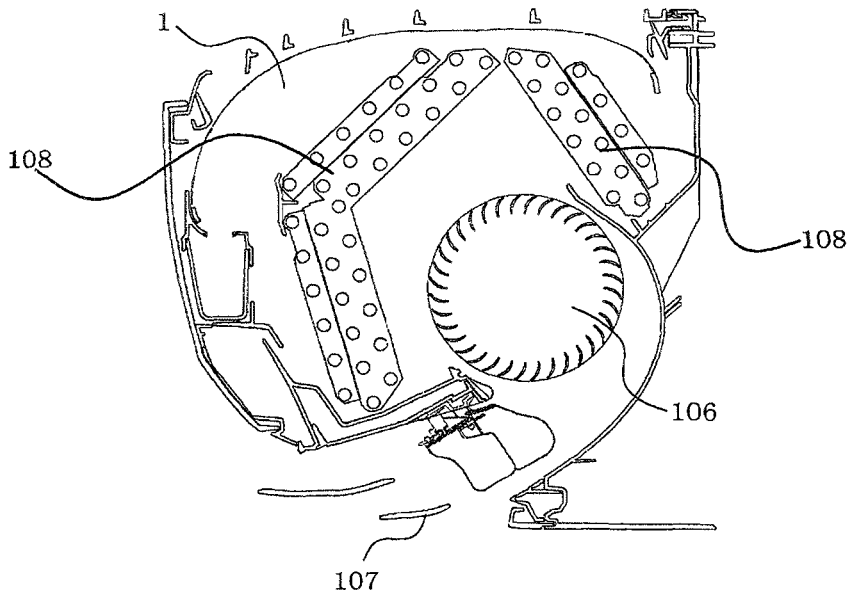
FIG. 3 is a cross-sectional view of an indoor unit of the air-conditioning apparatus according to the embodiment of the present invention.

FIG. 1 is a schematic diagram illustrating an air-conditioning system 500 including an air-conditioning apparatus 100 according to the embodiment. FIGS. 2A and 2B are diagrams for explaining the air-conditioning apparatus 100 according to the embodiment. FIG. 3 is a cross-sectional view of an indoor unit 1 of the air-conditioning apparatus 100 according to the embodiment. The air-conditioning apparatus 100 and the air-conditioning system 500 including the air-conditioning apparatus 100 will be described with reference to FIGS. 1 to 3.

[Air-Conditioning System 500]

As illustrated in FIG. 1, the air-conditioning system 500 includes the air-conditioning apparatus 100 including a controller 7, an adapter 2 connected to the air-conditioning apparatus 100, a router 8 to communicate with the adapter 2, a centralized management device 13 to communicate with the router 8 via an external network 11, and an operation terminal 9 (for example, a mobile phone) to communicate with the centralized management device 13.

(Air-Conditioning Apparatus 100)

The air-conditioning apparatus 100 includes the indoor unit 1 to supply conditioned air to an air-conditioned space (for example, a room in a house, a warehouse, or a room in a building), and an outdoor unit 1B including, for example, an expansion device 51 and a compressor 52. The indoor unit 1 is connected to the outdoor unit 1B by refrigerant pipes 63.

The indoor unit 1 is installed in, for example, a house 10. The indoor unit 1 includes an air-sending fan 106 to supply air to an air-conditioned space (for example, a room, a warehouse, or a room in a building), an air vane unit 107 used to adjust the direction of air blown from the air-sending fan 106, and an indoor heat exchanger 108 to be supplied with a refrigerant. The indoor unit 1 further includes a reception unit 3 to receive remote control information from the controller 7 which is an accessory to the indoor unit 1, a test operation switch 50 to allow the indoor unit 1 to perform a preset operation, and a control unit 21 electrically connected to the reception unit 3 and the test operation switch 50. The air vane unit 107 includes, for example, rotatable air vanes and a motor that rotates the air vanes. Although the following description assumes that the controller 7 is implemented using a remote controller capable of remotely operating the air-conditioning apparatus 100, the controller 7 is not limited to such an example. The controller 7 may be connected to the indoor unit 1 by wire.

The test operation switch 50 is used by a serviceperson to determine whether the indoor unit 1 operates properly in order to check or examine the air-conditioning apparatus 100. Specifically, the control unit 21 includes a program to set, for example, each of the rotation speed (including ON/OFF) of the air-sending fan 106, the angle of the air vane unit 107, the opening degree of the expansion device 51, and the rotation speed (including ON/OFF) of the compressor 52 to a preset value in order to check the operation of the indoor unit 1 or perform other operations involved. When the serviceperson turns on the test operation switch 50, the control unit 21 executes this program, thus driving, for example, the air-sending fan 106. The control unit 21 will be described in detail later with reference to FIG. 4.

The outdoor unit 1B is installed in an outdoor space, for example, on the roof of a building. The outdoor unit 1B includes the expansion device 51 to reduce the pressure of the refrigerant, the compressor 52 to compress the refrigerant, a four-way valve 53 to switch the flow path of the refrigerant, an outdoor heat exchanger 54 that functions as an evaporator in a heating operation and as a condenser (radiator) in a cooling operation, and an outdoor air-sending fan 55, which is provided to the outdoor heat exchanger 54, to supply air to the outdoor heat exchanger 54.

The outdoor unit 1B further includes an outdoor-unit control unit 21B electrically connected to the control unit 21. The outdoor-unit control unit 21B exchanges information with the control unit 21. The outdoor-unit control unit 21B is disposed in, for example, an electrical component box (not illustrated) placed in the upper portion of a compressor chamber that accommodates, for example, the compressor 52. The outdoor-unit control unit 21B controls the rotation speed of the compressor 52 and the opening degree of the expansion device 51 in accordance with information received from the control unit 21. Although the following description assumes that the expansion device 51 is placed inside the outdoor unit 1B, the present invention is not limited to such an example. The expansion device 51 may be disposed outside the outdoor unit 1B.

A driving unit of the air-conditioning apparatus 100 includes the air-sending fan 106 and the air vane unit 107 of the indoor unit 1, and the compressor 52, the expansion device 51, the four-way valve 53, and the outdoor air-sending fan 55 of the outdoor unit 1B. The indoor unit 1 may further include, for example, a plasma dust collector (not illustrated) attached to a dust collecting filter which is provided to the indoor unit 1. The plasma dust collector includes, for example, opposed electrodes and a power supply. The plasma dust collector is also included in the driving unit.

(Adapter 2)

The adapter 2 is connected to the control unit 21 of the indoor unit 1. The adapter 2 exchanges information with the control unit 21. The adapter 2 is connected to the router 8 by radio and is further connected via the router 8 to the external network 11. Although the embodiment assumes that the adapter 2 is not a constituent component of the air-conditioning apparatus 100, the configuration of the air-conditioning apparatus 100 is not limited to such an example. The air-conditioning apparatus 100 may include the adapter 2 as a constituent component.

(Router 8)

The router 8 serves as a communication device to relay data from the air-conditioning apparatus 100 and data from the operation terminal 9 between two or more different networks. More specifically, the router 8 serves as a communication device to perform relay operations between a network established by connecting, for example, the controller 7, the control unit 21, and the adapter 2 and the external network 11 established by connecting, for example, the centralized management device 13 and the operation terminal 9. The router 8 is connected to the adapter 2 by radio and is also connected via the external network 11 to the centralized management device 13. Examples of the external network 11 include the Internet 12. The centralized management device 13, such as a server, is connected to the Internet 12.

(Centralized Management Device 13)

The centralized management device 13 communicates with the operation terminal 9. When a user away from the house 10 issues an operation instruction to the indoor unit 1 using the operation terminal 9, information indicating details of an operation associated with the operation instruction is transmitted via the Internet 12 and is temporarily stored in the centralized management device 13. The centralized management device 13 regularly exchanges information with the indoor unit 1 via the adapter 2. Information is exchanged about once every five minutes, for example.

The control unit 21 outputs information concerning the indoor unit 1 to the adapter 2. The adapter 2 transmits the information received from the indoor unit 1 to the router 8.

The router 8 transmits the information received from the adapter 2 to the centralized management device 13 via the Internet 12.

The centralized management device 13 includes a storage unit 13B that stores information. Information used to send, for example, a response to the above-described transmission is stored in the storage unit 13B. The stored information is output from, for example, the centralized management device 13 to the router 8 via the Internet 12. That is, the router 8 receives the information output from the centralized management device 13 via the Internet 12. The router 8 transmits the received information to the adapter 2. The adapter 2 transmits the information received from the router 8 to the control unit 21. The centralized management device 13 regularly exchanges information with the indoor unit 1 in the above-described manner.

The centralized management device 13 performs the following control operation to prevent the operation of the air-conditioning apparatus 100 from being changed as the user operates the operation terminal 9. The centralized management device 13 includes an operation restricting unit 13A and is capable of controlling the operation terminal 9. When information indicating that a test operation mode is performed is received from the adapter 2 via the external network 11, the operation restricting unit 13A restricts an operation on the operation terminal 9 to prevent the operation of the air-conditioning apparatus 100 from being changed as the user operates the operation terminal 9 (refer to step S301 in FIG. 7; to be described later).

Figure 6:
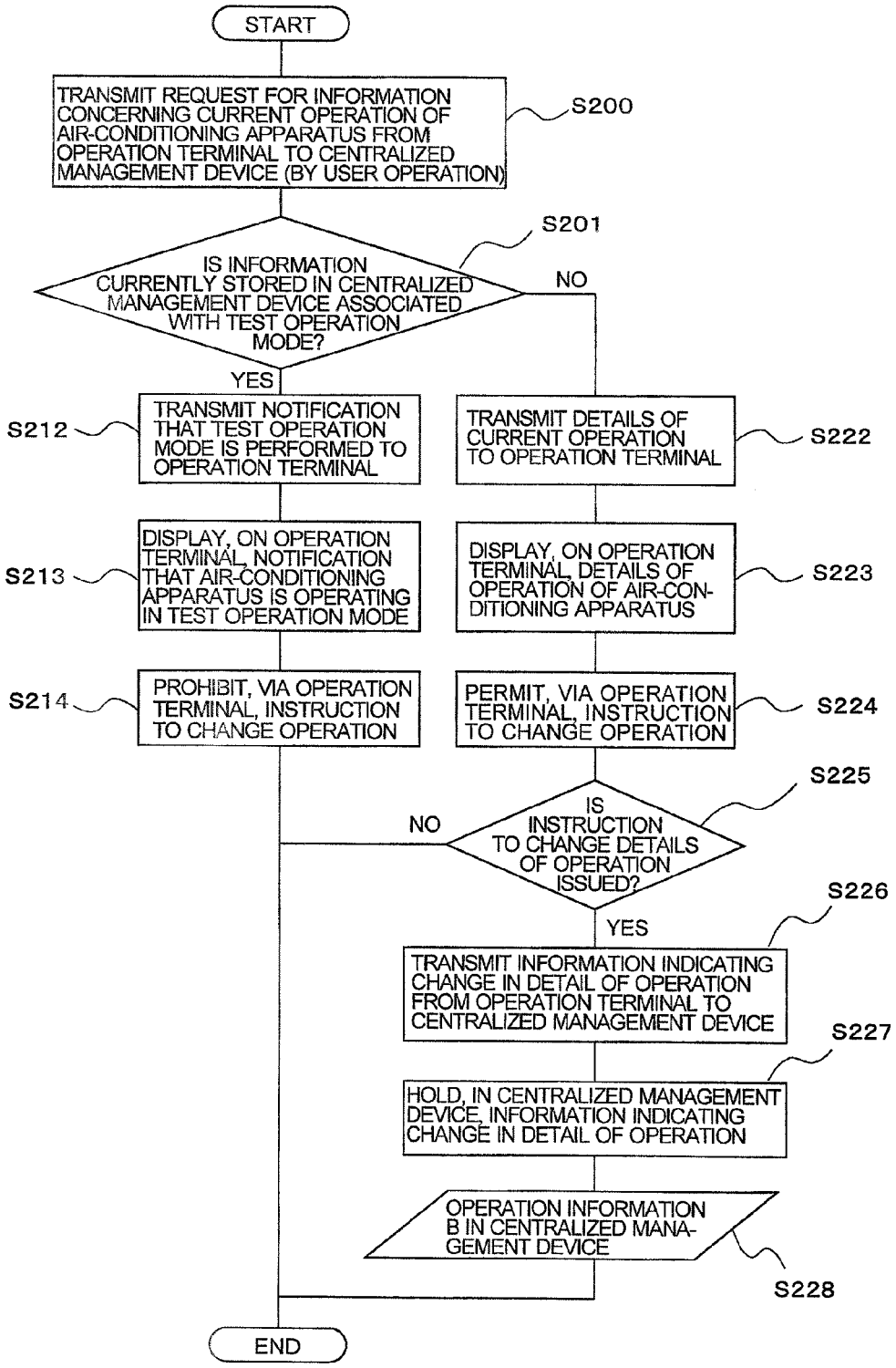
FIG. 6 is a flowchart illustrating a second control sequence of the air-conditioning apparatus according to the embodiment of the present invention.

Specifically, if information indicating that the air-conditioning apparatus 100 is currently operating in the test operation mode is stored in the storage unit 13B when the centralized management device 13 receives a request to provide information concerning the current operation of the air-conditioning apparatus 100 from the operation terminal 9, the centralized management device 13 (operation restricting unit 13A) allows the operation terminal 9 to display information indicating that the air-conditioning apparatus 100 is operating in the test operation mode (refer to step S213 in FIG. 6; to be described later). The operation restricting unit 13A then transmits an instruction to the operation terminal 9 to prevent details of the operation of the air-conditioning apparatus 100 from being changed. Upon this operation, even if the user tries to change details of the operation of the air-conditioning apparatus 100, an operation on the operation terminal 9 is restricted such that the operation of the air-conditioning apparatus 100 cannot be changed (refer to step S214 in FIG. 6; to be described later).

Furthermore, the operation restricting unit 13A of the centralized management device 13 performs a control operation different from the above-described control operation so that the operation of the air-conditioning apparatus 100 is not changed via the operation terminal 9. When information indicating that the test operation mode is performed is received, the operation restricting unit 13A of the centralized management device 13 stores the information in the storage unit 13B. The centralized management device 13 determines on the basis of test operation switch information received from the adapter 2 whether the test operation mode is performed. If the centralized management device 13 determines that the test operation mode is performed, it does not transmit to the adapter 2 operation information B that has been transmitted from the operation terminal 9 and been stored in the storage unit 13B.

(Operation Terminal 9)

The operation terminal 9 is implemented using, for example, a mobile phone. The operation terminal 9 is capable of communication with the centralized management device 13. The operation terminal 9 is not limited to a mobile phone. Any terminal capable of communication with the centralized management device 13 can be used.

The operation terminal 9 includes a program (application) used to operate the air-conditioning apparatus 100. This application is configured to accept an input to control the rate of air flow, an input to control the temperature, or an input to control the angle of the air vane unit 107. For example, when a user having the operation terminal 9 operates the operation terminal 9 to input information to change the air flow rate, the temperature, or the angle of the air vane unit 107, the input information is output to the control unit 21 via the centralized management device 13, the Internet 12, the router 8, and the adapter 2. In an example, the control unit 21 increases or reduces the rotation speed of the air-sending fan 106 in response to the received information to change the air flow rate. In another example, the control unit 21 controls the opening degree of the expansion device 51 and increases or reduces the rotation speed of the compressor 52 in response to the received information to change the temperature. In still another example, the control unit 21 operates the motor (not illustrated) to drive the air vane unit 107 in response to the received information to change the angle of the air vane unit 107.

[Refrigeration Cycle of Air-Conditioning Apparatus 100]

A refrigeration cycle operation of a refrigerant circuit, illustrated in FIG. 2A, will now be described with reference to FIG. 2A. Referring to FIG. 2A, the refrigerant in the refrigerant circuit flows in a direction indicated by solid arrows in a cooling operation and a dehumidifying operation, while the refrigerant in the refrigerant circuit flows in a direction indicated by dotted arrows in a heating operation.

The cooling operation will now first be described. When the cooling operation is started, the four-way valve 53 is switched so that the refrigerant in the refrigerant circuit flows in the direction indicated by the solid arrows in FIG. 2A. A gas refrigerant which is compressed by and discharged from the compressor 52 flows through the four-way valve 53 into the outdoor heat exchanger 54, where the gas refrigerant exchanges heat with outdoor air supplied from the outdoor air-sending fan 55 and condenses. The refrigerant then flows out of the outdoor heat exchanger 54. The refrigerant leaving the outdoor heat exchanger 54 flows into the expansion device 51, which expands it to a lower pressure. The refrigerant having its pressure reduced flows into the indoor heat exchanger 108, where the refrigerant exchanges heat with indoor air supplied from the air-sending fan 106 and gasifies. The refrigerant then flows out of the indoor heat exchanger 108. The gas refrigerant leaving the indoor heat exchanger 108 flows through the four-way valve 53 into the compressor 52 by suction.

The heating operation will now be described next. When the heating operation is started, the four-way valve 53 is switched so that the refrigerant flows in the direction indicated by the dotted arrows in FIG. 2A. A gas refrigerant which is compressed by and discharged from the compressor 52 flows through the four-way valve 53 into the indoor heat exchanger 108, where the gas refrigerant exchanges heat with indoor air supplied from the air-sending fan 106 and condenses. The refrigerant then flows out of the indoor heat exchanger 108. The refrigerant leaving the indoor heat exchanger 108 flows into the expansion device 51, which expands it to a lower pressure. The refrigerant having its pressure reduced flows into the outdoor heat exchanger 54, where the refrigerant exchanges heat with outdoor air supplied from the outdoor air-sending fan 55 and gasifies. The refrigerant then flows out of the outdoor heat exchanger 54. The gas refrigerant leaving the outdoor heat exchanger 54 flows through the four-way valve 53 into the compressor 52 by suction.

[Control Unit 21]

Figure 4:
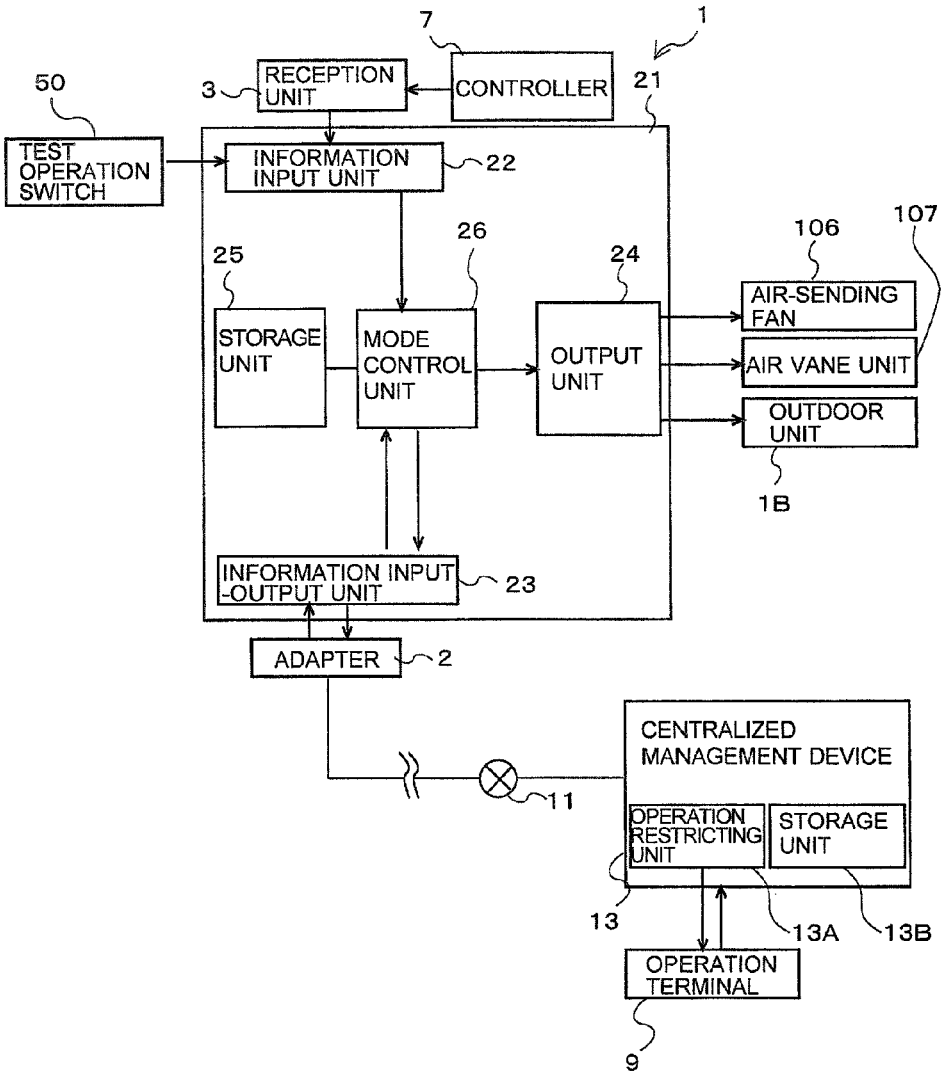
FIG. 4 is a block diagram illustrating the air-conditioning system according to the embodiment of the present invention.

The control unit 21 will now be described. FIG. 4 is a block diagram illustrating the air-conditioning system 500 according to the embodiment. The control unit 21 includes an information input unit 22, an information input-output unit 23, a storage unit 25, a mode control unit 26, and an output unit 24. The control unit 21 includes, for example, a microcomputer.

The information input unit 22 receives test operation switch information from the test operation switch 50 and processes the information. Furthermore, the information input unit 22 receives remote control information from the reception unit 3 which has received the remote control information from the controller 7, and processes the information.

The information input-output unit 23 receives operation information B from the adapter 2 which has received the operation information B from the centralized management device 13, and processes the information. Additionally, the information input-output unit 23 outputs information concerning the indoor unit 1 to the adapter 2. Examples of the information output from the information input-output unit 23 to the adapter 2 include remote control information.

The storage unit 25 stores, for example, various control setting values and programs. The storage unit 25 is implemented using, for example, a storage medium, such as a flash memory. The storage unit 25 stores a program to cause the air-conditioning apparatus 100 to perform the test operation mode which is a preset operation.

The program for the test operation mode includes, for example, (1) operating the air-sending fan 106 at a preset rotation speed for a preset period of time, (2) changing the angle of the air vane unit 107, and (3) driving a plasma dust collector on condition that the air-conditioning apparatus 100 includes the plasma dust connector. The program for the test operation mode may further include (4) performing the cooling operation or heating operation at a preset temperature. Specifically, in the above-described program content (1) operating the air-sending fan 106 of the indoor unit 1, the compressor 52 and the outdoor air-sending fan 55 of the outdoor unit 1B may further be driven and, upon this operation, the opening degree of the expansion device 51 may be controlled and the four-way valve 53 may be switched to change the flow path. The program for the test operation mode may further include (5) recovering the refrigerant in the refrigerant circuit of the air-conditioning apparatus 100 to the outdoor unit 1B.

The mode control unit 26 reads from the storage unit 25, for example, a control setting value or a program based on the remote control information or the operation information B. The mode control unit 26 performs an arithmetic operation on the information and then transmits the result of an arithmetic operation to the output unit 24 and/or the information input-output unit 23.

Upon receiving, for example, each of the operation information B, the remote control information, and the test operation switch information, the mode control unit 26 performs an arithmetic operation on the information and outputs (information indicating) the result of an arithmetic operation to the output unit 24 and/or the information input-output unit 23. Note that the remote control information and the test operation switch information correspond to adapter information A, which will be described later. The mode control unit 26 performs any of various arithmetic operations on the basis of information output from the information input unit 22 and the control setting values and the programs stored in the storage unit 25, and outputs the result of an arithmetic operation to the output unit 24 and/or the information input-output unit 23. When the test operation switch 50 is turned on, the mode control unit 26 transmits information indicating that the test operation mode is performed to the centralized management device 13 via the adapter 2 and the external network 11.

The output unit 24 receives information (indicating the result of an arithmetic operation) from the mode control unit 26, and outputs operation instructions to the air-sending fan 106, the air vane unit 107, and the outdoor unit 1B (or the outdoor-unit control unit 21B of the outdoor unit 1B).

[Operation of Control Unit 21]

Figure 5:
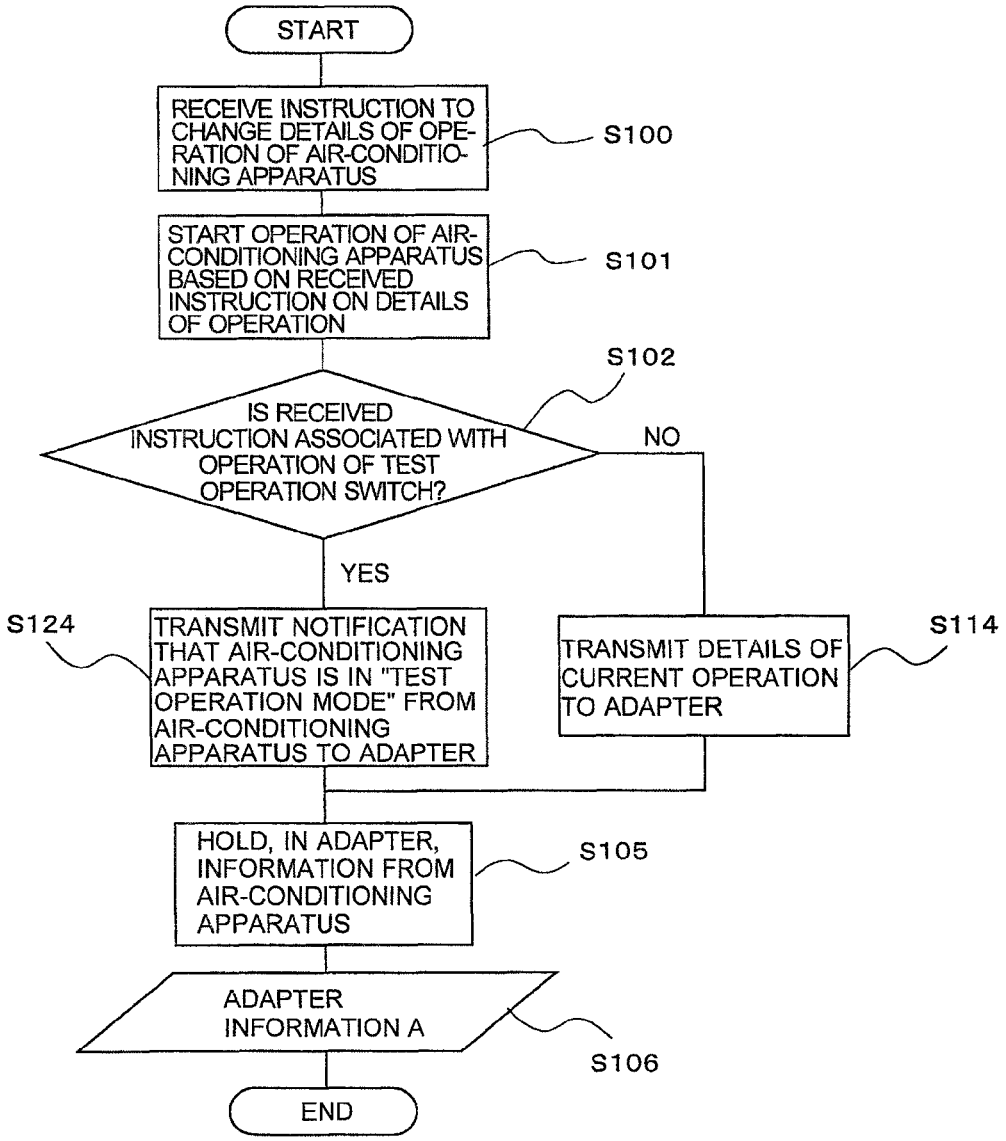
FIG. 5 is a flowchart illustrating a first control sequence of the air-conditioning apparatus according to the embodiment of the present invention.

FIG. 5 is a flowchart illustrating a first control sequence of the air-conditioning apparatus 100 according to the embodiment. An operation over the network including the control unit 21 and the adapter 2 will now be described with reference to FIG. 5.

The control unit 21 receives an instruction to change details of the operation or operation mode of the air-conditioning apparatus 100. Specifically, the control unit 21 receives remote control information from the controller 7 or test operation switch information from the test operation switch 50 (step S100). The control unit 21 allows the components (for example, the air-sending fan 106) to operate in accordance with the remote control information or the test operation switch information (step S101).

The control unit 21 determines whether the information received in step S100 is test operation switch information or remote control information (step S102). If the control unit 21 determines that the received information is test operation switch information (YES in step S102), it outputs to the adapter 2 information indicating that test operation switch information has been received (step S124). If the control unit 21 determines that the received information is remote control information (NO in step S102), it outputs to the adapter 2 information indicating details of the operation currently in progress, that is, information indicating that remote control information has been received (step S114).

The adapter 2 holds the information received from the control unit 21, that is, the information indicating that test operation switch information or remote control information has been received (step S105). In step S106, the information indicating that test operation switch information or remote control information has been received is held in the adapter 2. The information indicating that test operation switch information or remote control information has been received is referred to as "adapter information A".

FIG. 6 is a flowchart illustrating a second control sequence of the air-conditioning apparatus 100 according to the embodiment. An operation over the external network will now be described with reference to FIG. 6.

The user operates the operation terminal 9 to request information indicating how the air-conditioning apparatus 100 is currently operating (step S200). When receiving the request from the operation terminal 9, the centralized management device 13 determines whether the air-conditioning apparatus 100 is operating in the test operation mode (step S201). The result of determination by the centralized management device 13 in step S201 is regularly updated in step S300, which will be described later.

Figure 8:
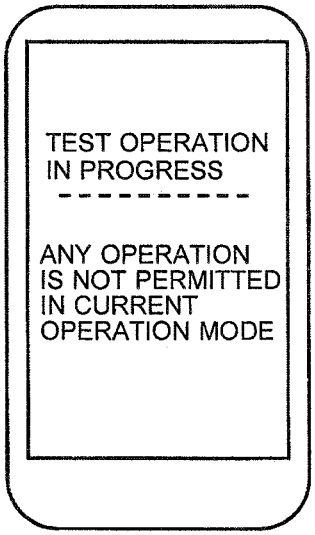
FIG. 8 illustrates an exemplary message displayed on an operation terminal.

If the centralized management device 13 determines that the air-conditioning apparatus 100 is operating in the test operation mode (YES in step S201), it outputs to the operation terminal 9 information indicating that the air-conditioning apparatus 100 is operating in the test operation mode (step S212). In response to the received information, the operation terminal 9 displays the information indicating that the air-conditioning apparatus 100 is operating in the test operation mode (step S213). FIG. 8 illustrates an exemplary message displayed on the operation terminal 9. The operation terminal 9 performs by internal control a lock operation to prevent the operation mode of the air-conditioning apparatus 100 from being changed as the user operates the operation terminal 9 (step S214). Consequently, the air-conditioning apparatus 100 is prevented from being operated remotely from a location away from the house, thus enabling a serviceperson to more reliably check the air-conditioning apparatus 100.

If the centralized management device 13 determines that the air-conditioning apparatus 100 is not operating in the test operation mode (NO in step S201), it outputs to the operation terminal 9 information indicating details of an operation which the air-conditioning apparatus 100 is currently performing (step S222). In response to the received information, the operation terminal 9 displays the information indicating details of the operation (step S223). The operation terminal 9 accepts an instruction to change the details of the operation of the air-conditioning apparatus 100 from the user who uses the operation terminal 9 (step S224).

The operation terminal 9 determines whether an instruction to change the details of the operation of the air-conditioning apparatus 100 is issued (step S225). If the operation terminal 9 determines that no instruction to change the details of the operation of the air-conditioning apparatus 100 is issued (NO in step S225), the control process returns to step S200. On the other hand, if the operation terminal 9 determines that an instruction to change the details of the operation of the air-conditioning apparatus 100 is issued (YES in step S225), it transmits information indicating a change in detail of the operation to the centralized management device 13 (step S226).

The centralized management device 13 holds the information received from the operation terminal 9. Specifically, the centralized management device 13 holds the information indicating a change in detail of the operation output from the operation terminal 9 (step S227). In step S228, the information indicating a change in detail of the operation output from the operation terminal 9 is held in the centralized management device 13. The information indicating a change in detail of the operation output from the operation terminal 9 will be referred to as "operation information B" hereinafter.

Figure 7:
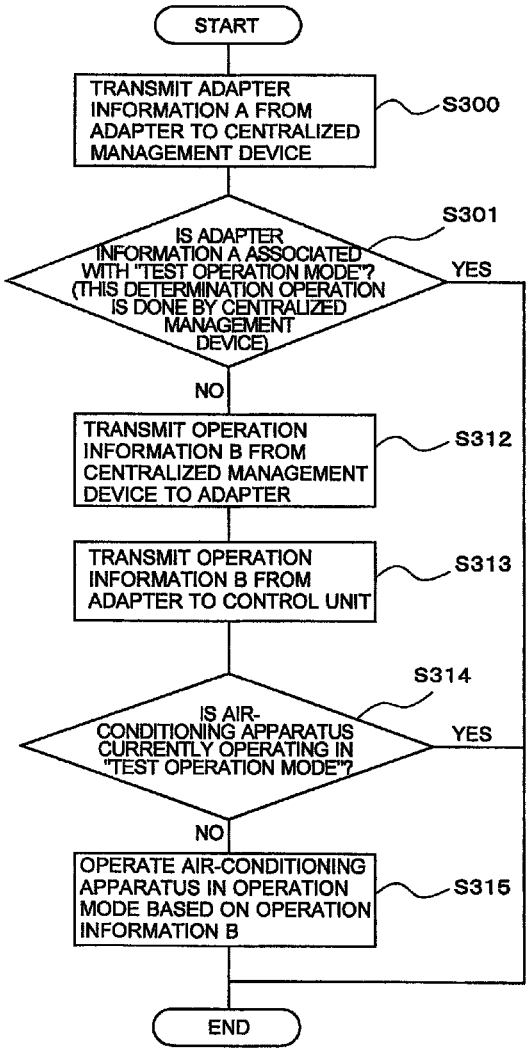
FIG. 7 is a flowchart illustrating a third control sequence of the air-conditioning apparatus according to the embodiment of the present invention.

FIG. 7 is a flowchart illustrating a third control sequence of the air-conditioning apparatus 100 according to the embodiment. An operation performed by the air-conditioning system 500 will be described on the basis of the operation over the network including the control unit 21 and the adapter 2, which has already been described with reference to FIG. 5, and the operation over the external network, which has already been described with reference to FIG. 6.

The adapter 2 outputs the adapter information A held in itself to the centralized management device 13 via the router 8 and the Internet 12 (step S300). The centralized management device 13 determines whether the adapter information A output from the adapter 2 is associated with test operation switch information (step S301). If the centralized management device 13 determines that the information is associated with test operation switch information (YES in step S301), it returns the process to step S300.

If the centralized management device 13 determines that the adapter information A is not associated with test operation switch information (NO in step S301), it outputs the operation information B held in itself to the adapter 2 via the Internet 12 and the router 8 (step S312). The adapter 2 outputs the received operation information B to the control unit 21 (step S313).

The control unit 21 determines whether the test operation switch 50 is ON (step S314). If the test operation switch 50 is OFF (NO in step S314), the control unit 21 operates various types of components (for example, the air-sending fan 106) in accordance with the operation information B designated by the user (step S315). For example, if the user has issued an instruction to increase the rate of air flow, the control unit 21 increases the rate of air flow provided by the air-sending fan 106. After that, the control process returns to step S300.

If the test operation switch 50 is ON (YES in step S314), the control unit 21 allows the air-conditioning apparatus 100 to operate in the test operation mode, regardless of the operation information B. After that, the control process returns to step S300. This is done when the control unit 21 communicates with the centralized management device 13 at a first timing, the operation information B to change the operation is output from the centralized management device 13 to the control unit 21 at a second timing, and the test operation switch 50 is turned on in the interval between the first timing and the second timing. Specifically, although the test operation switch 50 is OFF at the first timing (refer to steps S102 and S114 in FIG. 5) and the control unit 21 accordingly outputs the operation information B to the control unit 21 at the second timing (step S313) following several steps, the test operation switch 50 is turned on in the interval between the first timing and the second timing.

Advantages

While the air-conditioning apparatus 100 (air-conditioning system 500) according to the embodiment is operating in the test operation mode, the test operation mode is maintained, regardless of a user instruction output from the operation terminal 9 via the centralized management device 13, the Internet 12, the router 8, and the adapter 2. Accordingly, the air-conditioning apparatus 100 (air-conditioning system 500) can suppress degradation in ease of maintenance of the air-conditioning apparatus 100 as it becomes hard for a serviceperson to check or repair the air-conditioning apparatus 100.

When the test operation switch 50 is turned on, and a serviceperson checks the air-conditioning apparatus 100, he or she may detach a front panel (not illustrated) of the indoor unit 1 and insert his or her hands into the air-sending fan 106 or its vicinity. The air-conditioning apparatus 100 (air-conditioning system 500) according to the embodiment can prevent such an accident that a serviceperson injures his or her hand while inserting it into the air-sending fan 106 because in this state the air-sending fan 106 is driven in response to an instruction from the operation terminal 9.

Reference Signs List

| | | | | | | | |
|---|---|---|---|---|---|---|---|
| 1 | indoor unit | 1B | outdoor unit | 2 | adapter | | |
| 3 | reception unit | | 7 | controller | 8 | router | |
| 9 | operation terminal | | 10 | house | | | |
| 11 | external network | 12 | the Internet | | | | |
| 13 | centralized management device | | | | | | |

-continued

| Reference Signs List | | | |
|---|---|---|---|
| 13A | operation restricting unit | 13B | storage unit |
| 21 | control unit | 21B | outdoor-unit control unit |
| 22 | information input unit | | |
| 23 | information input-output unit | 24 | output unit |
| 25 | storage unit | 26 | mode control unit |
| 50 | test operation switch | 51 | expansion device |
| 52 | compressor 53 | four-way valve | |
| 54 | outdoor heat exchanger | | |
| 55 | outdoor air-sending fan | | |
| 63 | refrigerant pipe | 100 | air-conditioning apparatus |
| 106 | air-sending fan | 107 | air vane unit |
| 108 | indoor heat exchanger | | |
| 500 | air-conditioning system | | |
| A | adapter information | B | operation information |

The invention claimed is:

1. An air-conditioning system comprising:

an air-conditioning apparatus that includes an indoor unit and an outdoor unit;

an adapter connected to the indoor unit, the adapter being configured to communicate with the indoor unit; and a centralized management device configured to communicate with an operation terminal to receive an operation information B from the operation terminal and further communicate with the adapter via an external network, wherein the operation information B indicates a requested change in operation of the air-conditioning apparatus which is output from the operation terminal, the indoor unit including a test operation switch configured to initiate a test operation mode in which a preset operation is executed, and a control unit connected to the adapter, the control unit being configured to perform the test operation mode when the test operation switch is activated, the adapter holds an adapter information A received from the air-conditioning apparatus, wherein the adapter information A indicates an operation status of the air-conditioning apparatus; wherein the adapter is configured to repeatedly output the adapter information A held in itself to the centralized management device via the external network;

the control unit including a mode control unit configured to, when the test operation switch is activated, cause the adapter to transmit the adapter information A to the centralized management device via the adapter and the external network, wherein the centralized management device is configured to, while the adapter information A indicates that the test operation switch is activated, in response to receiving a request B from the operation terminal, wherein the request B requests information about a current operation of the air-conditioning apparatus, transmit an instruction A to the operation terminal, wherein the instruction A causes the operation terminal to prohibit an operation of the air-conditioning apparatus from being changed via the operation terminal;

wherein the centralized management device is further configured to, while the adapter information A indicates that the test operation switch is activated, restrict a transmission of the operation information B to the adapter;

wherein the centralized management device is further configured to, while the adapter information A indicates that the test operation switch is not activated, transmit the operation information B to the adapter and hold the operation information B in the centralized management device, wherein the control unit is further configured to: (i) while the test operation mode is activated, permit on-location components of the air-conditioning apparatus to operate according to the preset operation, and (ii) in a situation that the test operation mode is not activated when the adapter information A is received by the centralized management device at a first timing, the operation information B is output from the centralized management device to the control unit at a second timing that is later than the first timing, and the test operation mode is activated in an interval between the first timing and the second timing, operate the air-conditioning apparatus in the test operation mode regardless of the operation information B.

2. The air-conditioning system of claim 1, wherein when the adapter information A indicating that the test operation mode is performed is received, the centralized management device instructs the operation terminal to display information indicating that the air-conditioning apparatus is operating in the test operation mode.

3. The air-conditioning system of claim 1, wherein when the adapter information A indicating that the test operation mode is not performed is received, the centralized management device outputs the operation information B, received from the operation terminal, to the adapter via the external network, wherein the adapter outputs the operation information B received from the centralized management device to the control unit, and wherein when receiving the operation information B from the adapter, the control unit determines whether the test operation switch is activated to the test operation mode.

4. The air-conditioning system of claim 1, wherein the control unit is further configured with a program stored in advance for the test operation mode, wherein, when the test operation switch is activated to the test operation mode, the program stored in advance begins to operate.

5. The air-conditioning system of claim 4, wherein in the test operation mode, the program for the test operation mode which is stored in advance in the control unit performs predetermined operations of a plurality of the components of the air-conditioning apparatus.

6. The air-conditioning system of claim 4, wherein in the test operation mode, the program for the test operation mode which is stored in advance in the control unit sets one or more of: an operation speed of a fan of the air-conditioning apparatus, an angle of a vane of the air-conditioning apparatus, an opening degree of an expansion device of the air-conditioning apparatus, and a rotation speed of a compressor of the air-conditioning apparatus.

7. The air-conditioning system of claim 1, wherein the centralized management device is further configured to communicate with the indoor unit via the adapter on a recurring five minute basis.

8. The air-conditioning system of claim 1, wherein the control unit further comprises a flash memory which stores a program to cause the air-conditioning apparatus to perform the preset operation of the test operation mode.

9. An air-conditioning system comprising:

an air-conditioning apparatus that includes an indoor unit and an outdoor unit;

an adapter connected to the indoor unit, the adapter being configured to communicate with the indoor unit; and a centralized management device configured to communicate with an operation terminal to receive an operation information B from the operation terminal and further communicate with the adapter via an external network, wherein the operation information B indicates a requested change in operation of the air-conditioning apparatus which is output from the operation terminal, the indoor unit including a test operation switch configured to initiate a test operation mode in which a preset operation is executed, and a control unit connected to the adapter, the control unit being configured to perform the test operation mode when the test operation switch is activated, the adapter holds an adapter information A received from the air-conditioning apparatus, wherein the adapter information A indicates an operation status of the air conditioning apparatus; wherein the adapter is configured to repeatedly output the adapter information A held in itself to the centralized management device via the external network;

the control unit including a mode control unit configured to, when the test operation switch is activated, cause the adapter to transmit the adapter information A to the centralized management device via the adapter and the external network, and the centralized management device including a storage unit configured to store the operation information B, wherein the centralized management device is configured to, while the adapter information A indicates that the test operation switch is activated, in response to receiving a request B from the operation terminal, wherein the request B requests information about a current operation of the air-conditioning apparatus, transmit an instruction A to the operation terminal, wherein the instruction A causes the operation terminal to prohibit an operation of the air-conditioning apparatus from being changed via the operation terminal;

wherein the centralized management device is further configured to, while the adapter information A indicates that the test operation switch is activated, restrict a transmission of the operation information B to the adapter;

wherein the centralized management device is further configured to, while the adapter information A indicates that the test operation switch is not activated, transmit the operation information B to the adapter and hold the operation information B in the centralized management device, wherein the control unit is further configured to: (i) while the test operation mode is activated, permit on-location components of the air-conditioning apparatus to operate according to the preset operation, and (ii) in a situation that the test operation mode is not activated when the adapter information A is received by the centralized management device at a first timing, the operation information B is output from the centralized management device to the control unit at a second timing that is later than the first timing, and the test operation mode is activated in an interval between the first timing and the second timing, operate the air-conditioning apparatus in the test operation mode regardless of the operation information B.

10. The air-conditioning system of claim 9, wherein when the adapter information A indicating that the test operation mode is performed is received, the centralized management device instructs the operation terminal to display information indicating that the air-conditioning apparatus is operating in the test operation mode.

11. The air-conditioning system of claim 9, wherein when the adapter information A indicating that the test operation mode is not performed is received, the centralized management device outputs the operation information B received from the operation terminal, to the adapter via the external network, wherein the adapter outputs the operation information B received from the centralized management device to the control unit, and wherein when receiving the operation information B from the adapter, the control unit determines whether the test operation switch is activated to the test operation mode.

12. The air-conditioning system of claim 9, wherein the control unit is further configured with a program stored in advance for the test operation mode, wherein, when the test operation switch is activated to the test operation mode, the program stored in advance begins to operate.

13. The air-conditioning system of claim 12, wherein in the test operation mode, the program for the test operation mode which is stored in advance in the control unit performs predetermined operations of a plurality of components of the air-conditioning apparatus.

14. The air-conditioning system of claim 12, wherein in the test operation mode, the program for the test operation mode which is stored in advance in the control unit sets one or more of: an operation speed of a fan of the air-conditioning apparatus, an angle of a vane of the air-conditioning apparatus, an opening degree of an expansion device of the air-conditioning apparatus, and a rotation speed of a compressor of the air-conditioning apparatus.

15. The air-conditioning system of claim 9, wherein the centralized management device is further configured to communicate with the indoor unit via the adapter on a recurring five minute basis.

16. The air-conditioning system of claim 9, wherein the control unit further comprises a flash memory which stores a program to cause the air-conditioning apparatus to perform the preset operation of the test operation mode.

* * * * *